US011466480B2

(12) United States Patent
Akagi

(10) Patent No.: US 11,466,480 B2
(45) Date of Patent: Oct. 11, 2022

(54) DOOR LOCKING DEVICE

(71) Applicant: U-SHIN LTD., Tokyo (JP)

(72) Inventor: Nobuya Akagi, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 497 days.

(21) Appl. No.: 15/800,397

(22) Filed: Nov. 1, 2017

(65) Prior Publication Data

US 2018/0128021 A1 May 10, 2018

(30) Foreign Application Priority Data

Nov. 4, 2016 (JP) ..... JP2016-216629

(51) Int. Cl.
*E05B 77/26* (2014.01)

(52) U.S. Cl.
CPC ..... *E05B 77/26* (2013.01); *E05B 77/265* (2013.01)

(58) Field of Classification Search
CPC ..... E05B 77/24; E05B 77/245; E05B 77/26; E05B 77/265; E05B 77/28; E05B 77/283; E05B 77/287; Y10T 292/1082; Y10T 292/1047; Y10S 292/23
USPC ..... 292/201, 216, DIG. 23
See application file for complete search history.

(56) References Cited

U.S. PATENT DOCUMENTS 5,125,701 A 6/1992 Hayakawa et al.
5,681,068 A * 10/1997 Kleefeldt ..... E05B 13/005 292/336.3
5,762,383 A * 6/1998 Gomi ..... E05B 77/26 292/216
6,880,866 B2 * 4/2005 Tomaszewski ..... E05B 77/26 292/201
2012/0074719 A1 3/2012 Nagaoka
2014/0346785 A1 * 11/2014 Akagi ..... E05B 83/36 292/196
2016/0160540 A1 * 6/2016 Bejune ..... E05B 77/06 292/196

FOREIGN PATENT DOCUMENTS

| | | | | |
|---|---|---|---|---|
| CA | 2382487 A1 * | 3/2001 | ..... | E05B 77/26 |
| CN | 205206529 | 5/2016 | | |
| DE | 195 36 648 A1 | 4/1997 | | |
| JP | 60-51267 | 4/1985 | | |
| JP | 3-31666 | 3/1991 | | |
| JP | 2012-67541 | 4/2012 | | |

* cited by examiner

*Primary Examiner* — Christine M Mills
*Assistant Examiner* — Yahya Sidky
(74) *Attorney, Agent, or Firm* — Wenderoth, Lind & Ponack, L.L.P.

(57) ABSTRACT

A door locking device includes a latching mechanism configured to detachably lock a striker fixed to a vehicle body, an inner lever capable of rotating for releasing locking of the striker by the latching mechanism; and a child lever capable of rotating between an unlocked position where the inner lever is contactable with the child lever and a locked position where the inner lever is uncontactable with the child lever. The child lever is configured to transmit a rotational force of the inner lever to the latching mechanism by being rotated due to contacting of the inner lever with the child lever at the unlocked position.

10 Claims, 9 Drawing Sheets

DOOR LOCKING DEVICE

CROSS-REFERENCE TO RELATED APPLICATION

This application claims priority of Japanese Patent Application No.: 2016-216629 filed on Nov. 4, 2016, the content of which is incorporated herein by reference.

BACKGROUND OF THE INVENTION

Technical Field

The present invention relates to a door locking device.

Description of the Related Art

A door locking device with a child locking mechanism is mounted on, e.g., a rear door of a vehicle. The child locking mechanism prevents a door from being opened even when an inner handle is operated. A door locking device disclosed in JP 2012-67541 A includes an inner lever connected to an inner handle, an outer lever connected to a latching mechanism, and a child lever which switches a connection state (an unlocked state and a locked state) between the inner lever and the outer lever by a slide operation. In such a door locking device, when the child lever is switched to the unlocked position, a rotational force of the inner lever is transmitted to the outer lever so that locking of a striker by the latching mechanism is released. When the child lever is switched to the locked position, a rotational force of the inner lever cannot be transmitted to the outer lever and hence, locking of the striker by the latching mechanism cannot be released.

SUMMARY OF THE INVENTION

In the door locking device disclosed in JP 2012-67541 A, the child lever is switched to either an unlocked position or a locked position by sliding, and the inner lever and the outer lever transmit power to the latching mechanism due to the respective rotations of the inner lever and the outer lever. Therefore, the child lever is required to generate movements which differ in nature, that is, sliding (linear motion) and rotation and hence, high accuracy is necessary in designing and manufacture of the door locking device (child locking mechanism). Further, due to deterioration over a lapse of time or the like, a defective operation of the child lever more likely to occur and hence, reliability of the child locking mechanism is low.

It is an object of the present invention to provide a door locking device which requires neither designing nor manufacture of the door locking device with high accuracy, and possesses high reliability by making a defective operation minimally occur.

According to an aspect of the present invention provides a door locking device comprising: a latching mechanism configured to detachably lock a striker fixed to a vehicle body; an inner lever capable of rotating for releasing locking of the striker by the latching mechanism; and a child lever capable of rotating between an unlocked position where the inner lever is contactable with the child lever and a locked position where the inner lever is uncontactable with the child lever, and configured to transmit a rotational force of the inner lever to the latching mechanism by being rotated due to contacting of the inner lever with the child lever at the unlocked position.

In such a door locking device, when the child lever is rotatably operated, the child lever is switched between an unlocked state and a locked state. When the child lever at the unlocked position receives a rotational force of the inner lever, the child lever is rotated so that the rotational force of the inner lever is transmitted to the latching mechanism whereby locking of the striker by the latching mechanism is released. On the other hand, when the child lever is at the locked position, the child lever cannot receive a rotational force of the inner lever so that the rotational force of the inner lever cannot be transmitted to the latching mechanism whereby locking of the striker by the latching mechanism cannot be released.

According to the door locking device of the present invention, with the use of the rotary-type child lever, switching of the child lever between an unlocked state and a locked state and transmission of a rotational force of the inner lever to the latching mechanism are performed due to only a rotational operation of the child lever and hence, designing and manufacture of the door locking device with high accuracy are unnecessary. Further, even when the child lever is deteriorated over a lapse of time, a defective operation minimally occurs and hence, reliability of the child locking mechanism can be enhanced.

DETAILED DESCRIPTION OF THE PREFERRED EMBODIMENTS

Hereinafter, embodiments of the present invention are described with reference to drawings.

First Embodiment

Figure 1:
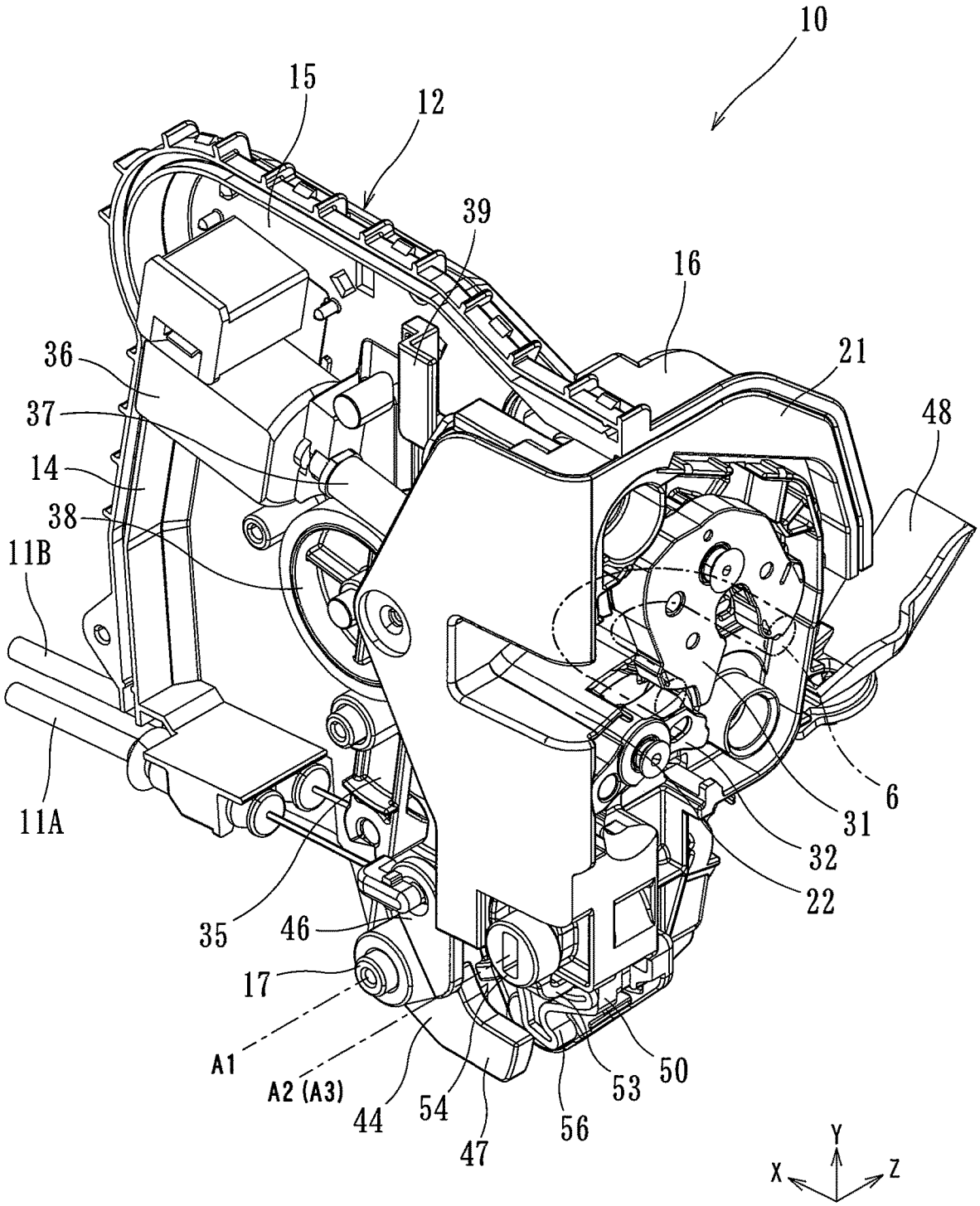
FIG. 1 is a perspective view showing a door locking device according to a first embodiment.
Figure 2:
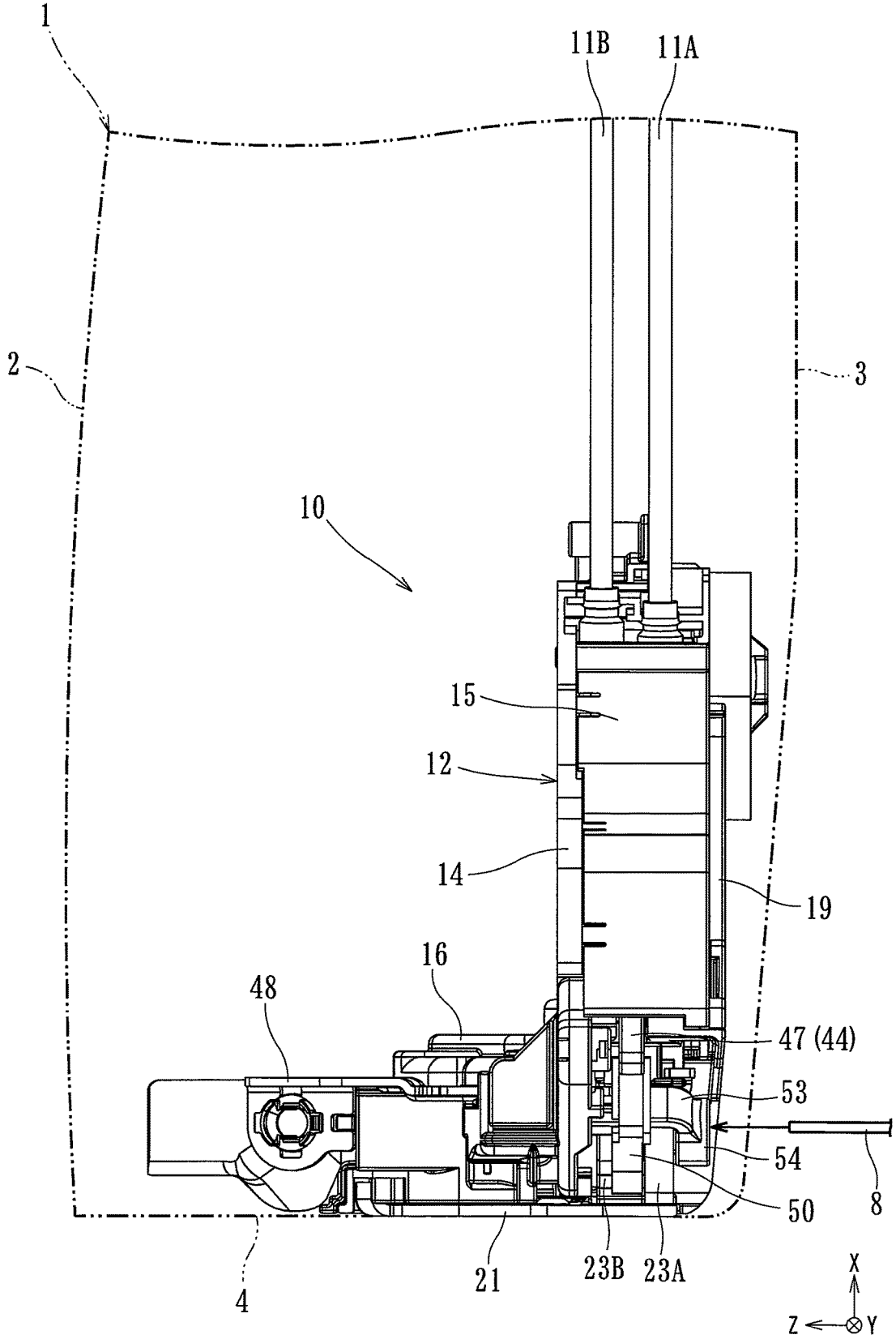
FIG. 2 is a bottom plan view of the door locking device in FIG. 1.

FIGS. 1 to 8B show a door locking device 10 according to a first embodiment of the present invention. As shown in FIG. 2, the door locking device 10 is arranged, e.g., in an inside of a rear door 1 (between an outer panel 2 and an inner panel 3) of a vehicle. In FIGS. 1 to 8B, a vehicle longitudinal direction of the door 1 is assumed as an X direction, a vehicle height direction of the door 1 is assumed as a Y direction, and a vehicle width direction of the door 1 is assumed as a Z direction.

On the inner panel 3 positioned on a cabin side, an inner handle for opening the door 1 (not shown in the drawing) is arranged. With reference to FIGS. 1 and 2, an inner lever 44 of the door locking device 10 is connected to the inner handle by a cable 11A. A child lever 50 for switching the door locking device 10 between a child unlocked state and a child locked state is arranged on the side of the inner lever 44. In this embodiment, designing and manufacture of the inner lever 44 and the child lever 50 with high accuracy in shape, arrangement and the like become unnecessary, and reliability in switching the child lever 50 can be enhanced.

(Configuration of Door Locking Device)

As shown in FIGS. 1 and 2, the door locking device 10 includes a housing 12 having an approximately L shape as viewed in a plan view. The housing 12 includes a main case 14, a cover 19, and a sub case 21. In the main case 14, a second accommodating portion 16 projects from one end of a first accommodating portion 15 in a direction perpendicular to the first accommodating portion 15. The cover 19 closes an opening formed in the first accommodating portion 15. The sub case 21 is arranged on the second accommodating portion 16. The cover 19 is arranged so as to extend in the X direction along the inner panel 3, and the sub case 21 is arranged so as to extend in the Z direction along an end surface 4. The end surface 4 is positioned on a side opposite to a hinge connecting portion where the door 1 is connected to a vehicle body.

A latching mechanism, a switching mechanism, and an opening mechanism are arranged in the housing 12. Among these mechanisms, some parts in a group of parts which form the switching mechanism and some parts in a group of parts which form the opening mechanism are arranged in the first accommodating portion 15. A group of parts which form the latching mechanism and the remaining parts in the group of parts which form the opening mechanism are arranged in the sub case 21.

The latching mechanism maintains the door 1 in a closed state with respect to the vehicle body by detachably locking a striker 6 fixed to the vehicle body. The latching mechanism includes a fork 31 and a claw 32. When the striker 6 advances relative to the sub case 21 along an insertion groove 22 of the sub case 21, the fork 31 is rotated to a locked position as shown in FIG. 1, and the striker 6 is locked by the fork 31. When the claw 32 locks the fork 31, the fork 31 is held at a locked position by the claw 32. When the claw 32 is rotated in a clockwise direction in FIG. 1, locking of the fork 31 by the claw 32 is released, and the fork 31 is rotated in a clockwise direction by a biasing force of a spring (not shown in the drawing). With such an operation, the striker 6 becomes detachable from the fork 31.

The switching mechanism is configured to switch the door locking device 10 between a door unlocked state where power of the releasing mechanism can be transmitted to the latching mechanism and a door locked state where power of the releasing mechanism cannot be transmitted to the latching mechanism. The switching mechanism includes a lock lever 35, a motor 36, a worm 37, a worm wheel 38, a joint 39, a switching lever (not shown in the drawing), and a link 40. When a lock knob (not shown in the drawing) of the door 1 is operated, the lock lever 35 connected to the lock knob by a cable 11B is rotated so that the joint 39 is linearly moved in the Y direction. When an electronic key is operated, the worm wheel 38 is rotated by way of the worm 37 by driving of the motor 36 so that the joint 39 is linearly moved in the Y direction. When the joint 39 is linearly moved downward in the Y direction, the link 40 is rotated to a door unlocked position by way of the switching lever. When the joint 39 is linearly moved upward in the Y direction, the link 40 is rotated to a door locked position by way of the switching lever.

The releasing mechanism is configured to transmit an operational force of the inner handle of the door 1 and an operational force of the outer handle of the door 1 to the latching mechanism by way of the switching mechanism. The releasing mechanism includes an inner lever 44 connected to the inner handle by the cable 11A, and an outer lever 48 connected to the outer handle by a rod (not shown in the drawing). When the inner handle is operated, the inner lever 44 is rotated thus moving the link 40 upward by way of the child lever 50. When the outer handle is operated, the outer lever 48 is rotated thus directly moving the link 40 upward. In a case of the door unlocked state, an operation portion 41 of the link 40 is brought into contact with an operation receiving portion 33 of the claw 32 (see FIG. 4A) thus transmitting a rotational force of the levers 44, 48 to the claw 32 so that locking of the striker 6 by the fork 31 is released. In a case of the door locked state, the operation portion 41 swings uselessly without coming into contact with the operation receiving portion 33 and hence, rotational forces of the levers 44, 48 cannot be transmitted to the claw 32 whereby locking of the striker 6 by the fork 31 cannot be released.

(Detailed Configuration of Child Locking Mechanism)

On the door locking device 10 of this embodiment, a child locking mechanism which disables an operation of the inner handle is mounted for preventing a child on a vehicle from unexpectedly opening the door 1. As shown in FIGS. 3A to 4B, the child locking mechanism includes the child lever 50 for transmitting a rotational force of the inner lever 44 to the link 40.

Also with reference to FIG. 1, a shaft hole 45 is formed in the inner lever 44. Because of the formation of the shaft hole 45, the inner lever 44 can be arranged on the main case 14 in a rotatable manner. An axis of a shaft portion 17 of the main case 14 which becomes a rotary axis A1 of the inner lever 44 extends in the Z direction. Further, formed on the inner lever 44 is a connecting portion 46 for connecting the inner lever 44 to the cable 11A as well as a pressing portion 47 for rotating the child lever 50.

The pressing portion 47 projects toward the child lever 50, and is positioned below the link 40. When the inner handle is operated, the pressing portion 47 is rotatable from a non-operation position shown in FIGS. 3A and 3B (first rotational angle position) to an opening operation position shown in FIGS. 4A and 4B (second rotational angle position). An operation receiving portion 42 which forms a lower end of the link 40 is not positioned within a rotatable range of the pressing portion 47 and hence, the inner lever 44 cannot operate the link 40 directly.

The child lever 50 is arranged in the sub case 21 so as to be positioned in a spaced apart manner with respect to the inner lever 44 in the X direction. The child lever 50 is rotatable to a child unlocked position shown in FIG. 3A, a child locked position shown in FIG. 3B, and an opening operation position shown in FIG. 4A. The child lever 50 at a child unlocked position receives a rotational force of the inner lever 44 and can transmit the rotational force to the claw 32 by way of the link 40. The child lever 50 at a child locked position cannot receive a rotational force of the inner lever 44 and hence, the child lever 50 cannot transmit a rotational force of the inner lever 44 to the claw 32.

Figure 5:
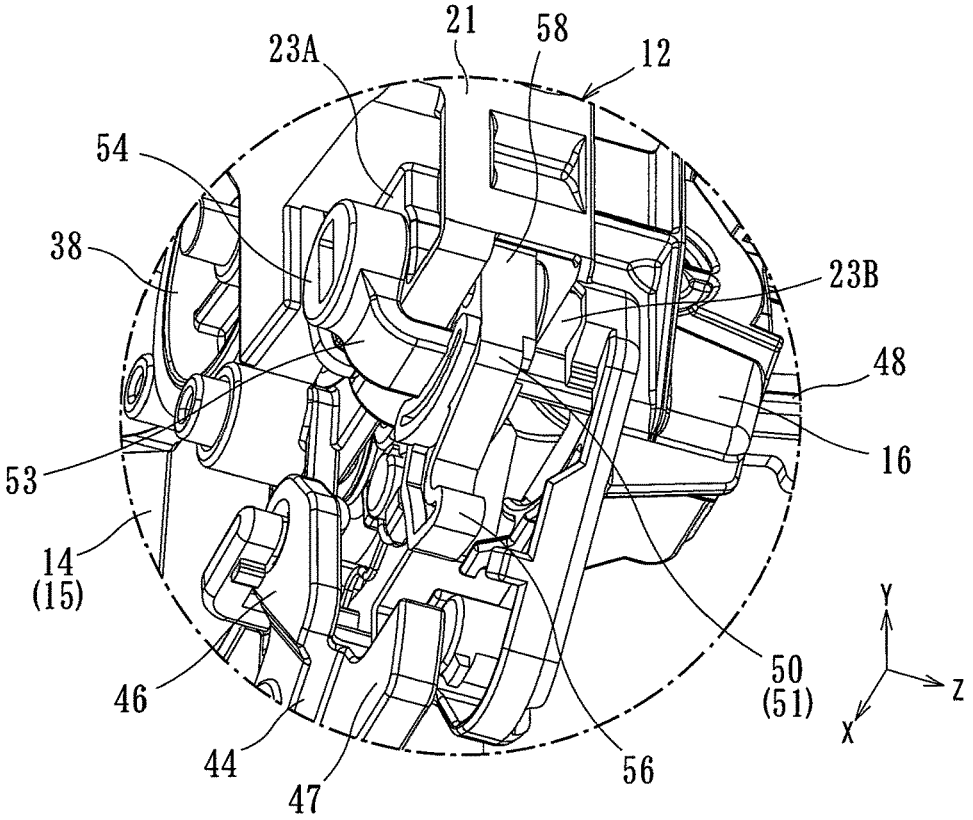
FIG. 5 is a perspective view showing a mounting state of a child lever as viewed from below.
Figure 6:
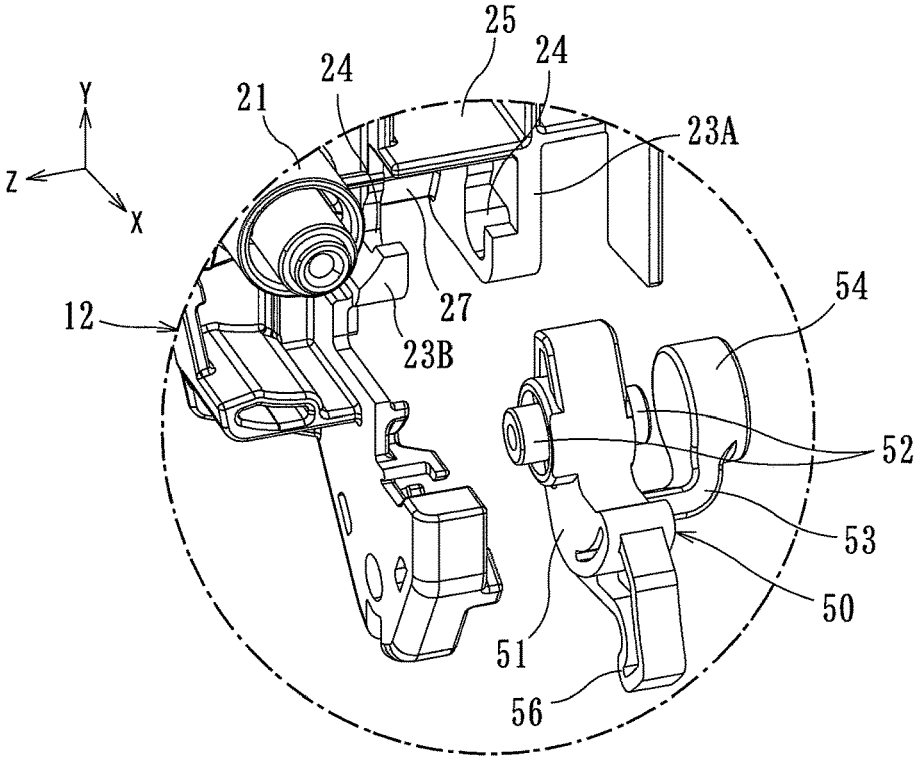
FIG. 6 is a perspective view showing a mounting structure of the child lever.

With reference to FIGS. 5 and 6, mounting walls 23A, 23B for arranging the child lever 50 are formed on the sub case 21 in a spaced apart manner in the Z direction. On facing portions of the respective mounting portions 23A, 23B, approximately U-shaped mounting grooves 24, 24 having upper ends thereof opened are formed respectively.

The child lever 50 includes a plate-like body portion 51 having a predetermined wall thickness. On the body portion, shaft portions 52, 52 which are pivotally supported by the mounting grooves 24, 24 are formed in an outwardly projecting manner. A rotary axis A2 of the child lever 50 (shaft portion 52) mounted on the sub case 21 is parallel to a rotary axis A1 of the inner lever 44. Accordingly, the child lever 50 and the inner lever 44 are rotatable on the same plane.

Figure 7:
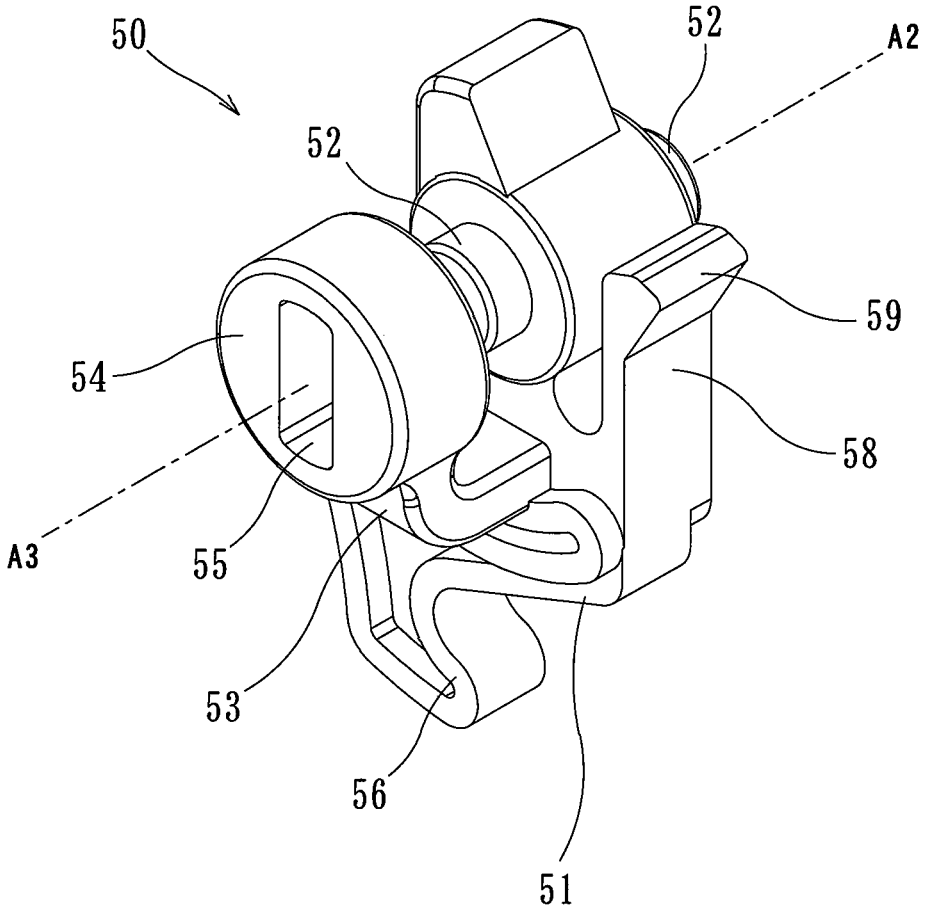
FIG. 7 is a perspective view of the child lever.

With reference to FIGS. 5 and 7, the child lever 50 includes a switching operation portion 54 for switching the child lever 50 between a child unlocked state and a child locked state. The switching operation portion 54 is integrally formed with the body portion 51 by way of an arm 53. The arm 53 projects from one surface of the body portion 51, and the switching operation portion 54 having an approximately circular columnar shape is formed on a distal end of the arm 53.

A rotary axis A3 of the switching operation portion 54 and a rotary axis A2 of the shaft portion 52 are positioned on the same axis. Further, the switching operation portion 54 and the shaft portion 52 (body portion 51) are arranged in a spaced-apart manner along rotary axes A2, A3 by the arm 53. The body portion 51 is arranged between the pair of mounting walls 23A, 23B, and the switching operation portion 54 is arranged between the inner panel 3 and the mounting wall 23A. An insertion portion 55 formed of an elongated groove is formed on the switching operation portion 54. By inserting a plate-like member 8 such as a key (see FIG. 2) into the insertion portion 55 and by rotating the switching operation portion 54, the child lever 50 can be rotated. A circular-shaped insertion hole (not shown in the drawing) is formed in the inner panel 3 at a position opposedly facing the insertion portion 55.

In other words, the switching operation portion 54 is disposed in a spaced-apart manner from the body portion 51 by the arm 53, the pair of shaft portions 52, 52 can be mounted on the body portion 51. Accordingly, the child lever 50 can be pivotally supported by the housing 12 with a both-ends supported structure. With such a configuration, a rotational operation of the child lever 50 can be made stable and hence, a defective operation of the child locking mechanism can be prevented. Further, the switching operation portion 54 having a large shape can be formed and hence, an operation using the plate-like member 8 can be performed thus also enhancing operability of the child lever 50.

In a slide-operation-type child lever, it is necessary to project a switching operation portion to the outside (a cabin side) from an inner panel. Further, for preventing a person getting in/out of a vehicle from interfering with the switching operation portion, it is necessary to form a recessed portion on the inner panel, for example. Accordingly, it is necessary to apply additional working to the door 1 and a design property of the door 1 is also deteriorated.

Contrarily to this, the rotational-operation-type child lever 50 can adopt the configuration where the child lever 50 is operated by inserting the plate-like member 8 into the child lever 50 and hence, the switching operation portion 54 can be arranged in the inside of the inner panel 3. Accordingly, it is unnecessary to apply an additional working such as a formation of a recessed portion on the inner panel 3 and, further, deterioration of a design property of the door 1 can be prevented.

With reference to FIGS. 3A to 4B, the child lever 50 includes a contact portion 56 which is positioned between the operation receiving portion 42 and the pressing portion 47. When the contact portion 56 is at a child unlocked position shown in FIG. 3A, the contact portion 56 is positioned at a rotational angle which allows the pressing portion 47 to be in contact with the contact portion 56, and a distal end side of the contact portion 56 projects within a rotational range of the pressing portion 47. When the contact portion 56 is at a child locked position shown in FIG. 3B, the contact portion 56 is positioned at a rotational angle which does not allow the pressing portion 47 to be in contact with the contact portion 56, and is separated from the rotational range of the pressing portion 47. Further, formed on a proximal portion side of the contact portion 56 is an operation portion 57 which is contactable with the operation receiving portion 42 of the link 40 by rotation.

Figure 8A:
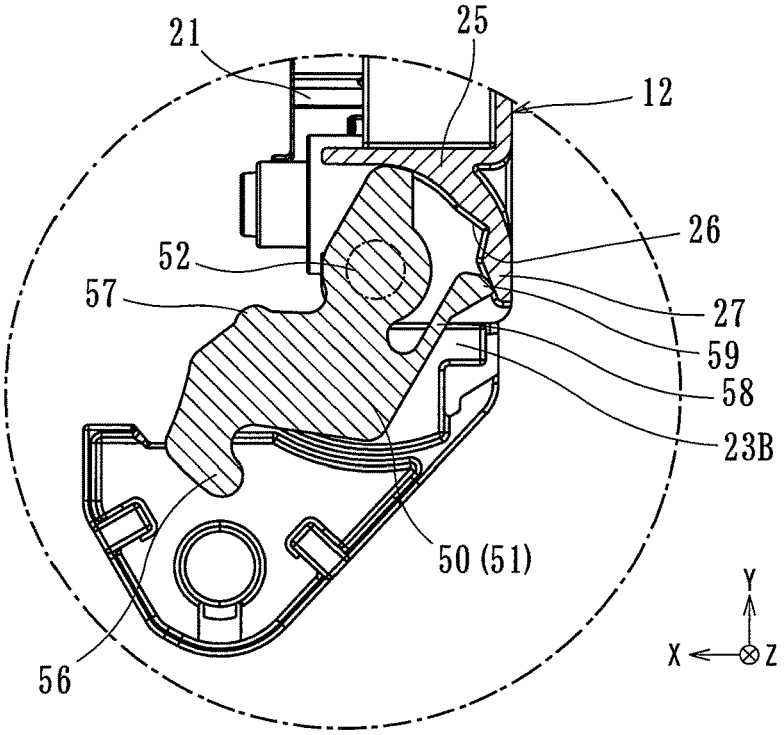
FIG. 8A is a cross-sectional view showing the child lever in an unlocked state.
Figure 8B:
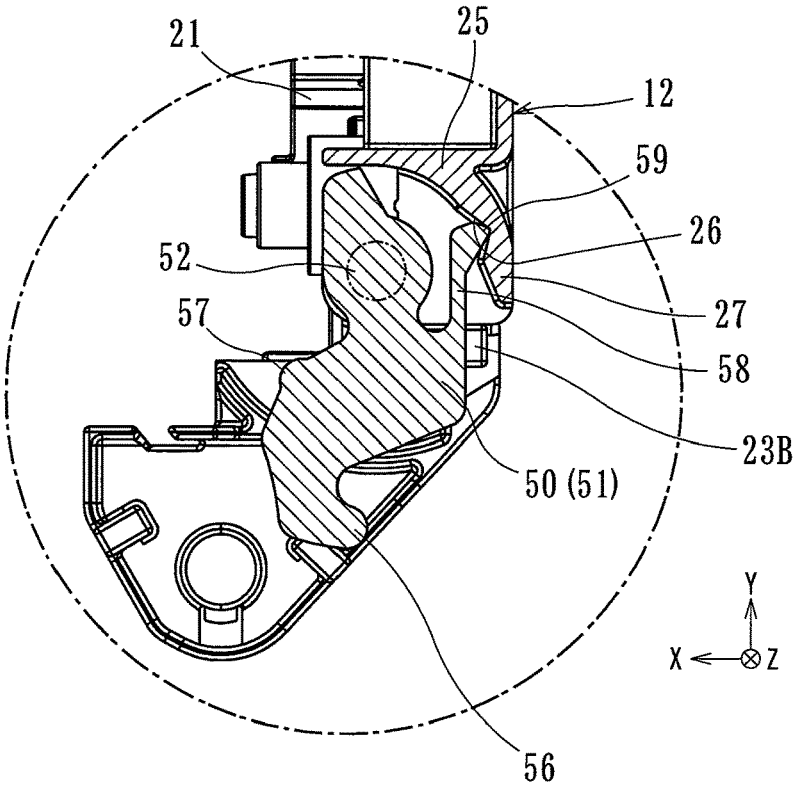
FIG. 8B is a cross-sectional view showing the child lever in a locked state.

With reference to FIGS. 7 to 8B, a biasing portion 58 for positioning the child lever 50 with respect to the housing 12 with no rattling is integrally formed with the child lever 50. The biasing portion 58 is disposed on a side opposite to the contact portion 56 of the body portion 51 in the X direction. The biasing portion 58 has an arm shape while having a predetermined wall thickness, and a locking projecting portion 59 which projects outward in the X direction is formed on a distal end of the biasing portion 58.

The sub case 21 includes an upper wall 25 having a curved shape about the rotary axis A2 of the mounting groove 24 such that the upper wall 25 closes an upper portion of the pair of mounting walls 23A, 23B. As shown in FIG. 8B, a locking recessed portion 26 is formed on the upper wall 25, and the locking projecting portion 59 rotated at a child locked position is locked with the locking recessed portion 26. As shown in FIG. 8A, the upper wall 25 includes a slide contact portion 27 which is slidable on the locking projecting portion 59 in a pressure contact state with the slide contact portion 27 when the child lever 50 is rotated from a child locked position to a child unlocked position.

In the door locking device 10 having the above-mentioned configuration, the locking projecting portion 59 is brought into pressure contact with (biased to) the slide contact portion 27 in a child unlocked state, and the locking projecting portion 59 is locked to the locking recessed portion 26 in a child locked state. Accordingly, it is possible to prevent the occurrence of rattling of the child lever 50 with respect to the housing 12 and hence, the generation of noise during traveling of a vehicle can be prevented.

Next, the manner of operation of the child locking mechanism is described.

Figure 3A:
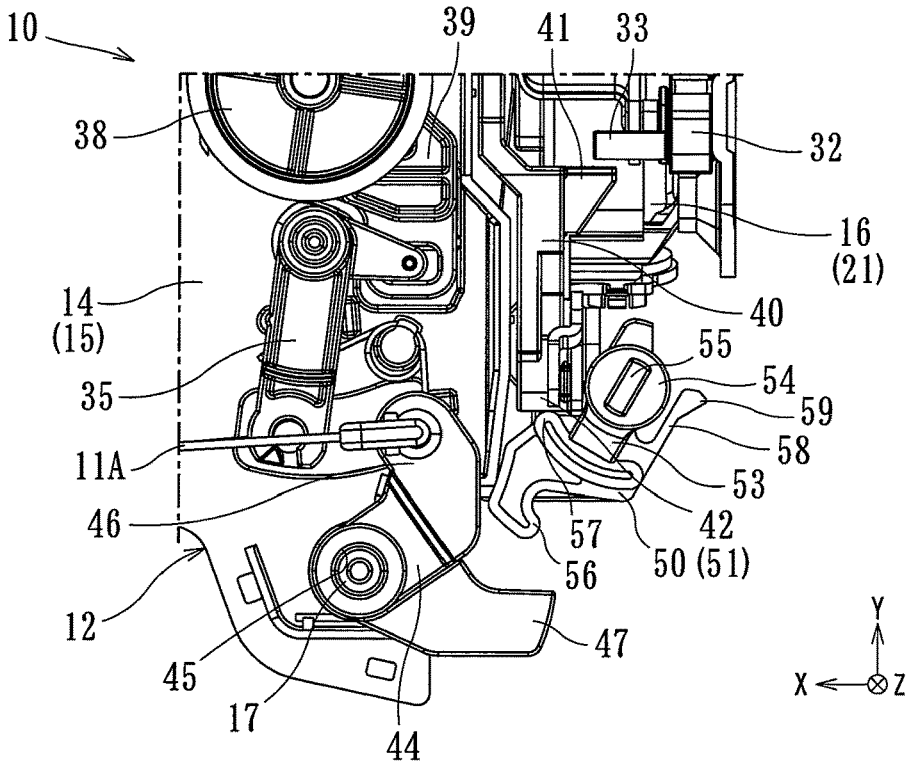
FIG. 3A is a front view showing an unlocked state of the door locking device shown in FIG. 1.
Figure 3B:
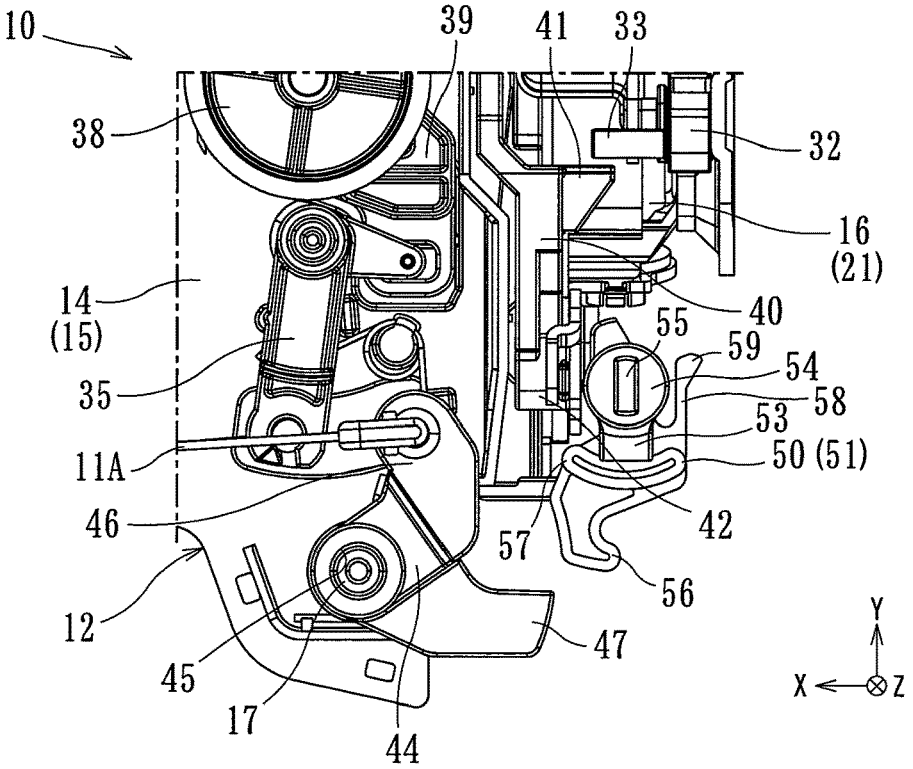
FIG. 3B is a front view showing a locked state of the door locking device shown in FIG. 1.

When the child lever 50 positioned at a child unlocked position shown in FIG. 3A is rotated in a counterclockwise direction (a first direction) by an operation of the switching operation portion 54, the child lever 50 is rotated to a child locked position shown in FIG. 3B. Further, when the child lever 50 at a child locked position shown in FIG. 3B is rotated by being rotated in a clockwise direction (a second direction opposite to the first direction) by an operation of the switching operation portion 54, the child lever 50 is rotated to a child unlocked position shown in FIG. 3A. In such an operation, in this embodiment, the rotary axis A2 of the shaft portion 52 and the rotary axis A3 of the switching operation portion 54 are arranged on the same axis and hence, the operability of the child lever 50 can be enhanced.

With respect to the child lever 50 at a child unlocked position, when the inner lever 44 is rotated in an opening operation direction (counterclockwise direction), the pressing portion 47 is brought into contact with the contact portion 56 so that the child lever 50 is rotated in a clockwise direction (second direction). When the child lever 50 is rotated up to an opening operation position shown in FIG. 4A, the operation portion 57 presses the operation receiving portion 42 of the link 40 so that the child lever 50 transmits a rotational force of the inner lever 44 to the link 40. When the link 40 is in a door unlocked state, the door 1 is brought into an openable state as described above, and when the link 40 is in a door locked state, the door 1 cannot be opened as described above.

Figure 4A:
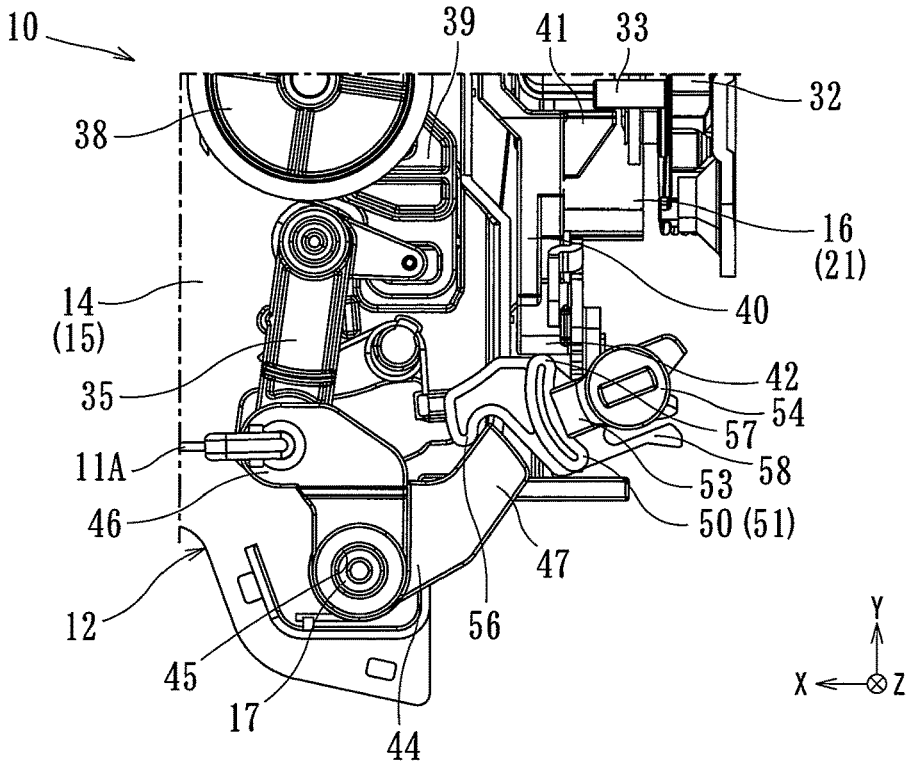
FIG. 4A is a front view showing a state where an inner lever is operated in an unlocked state.
Figure 4B:
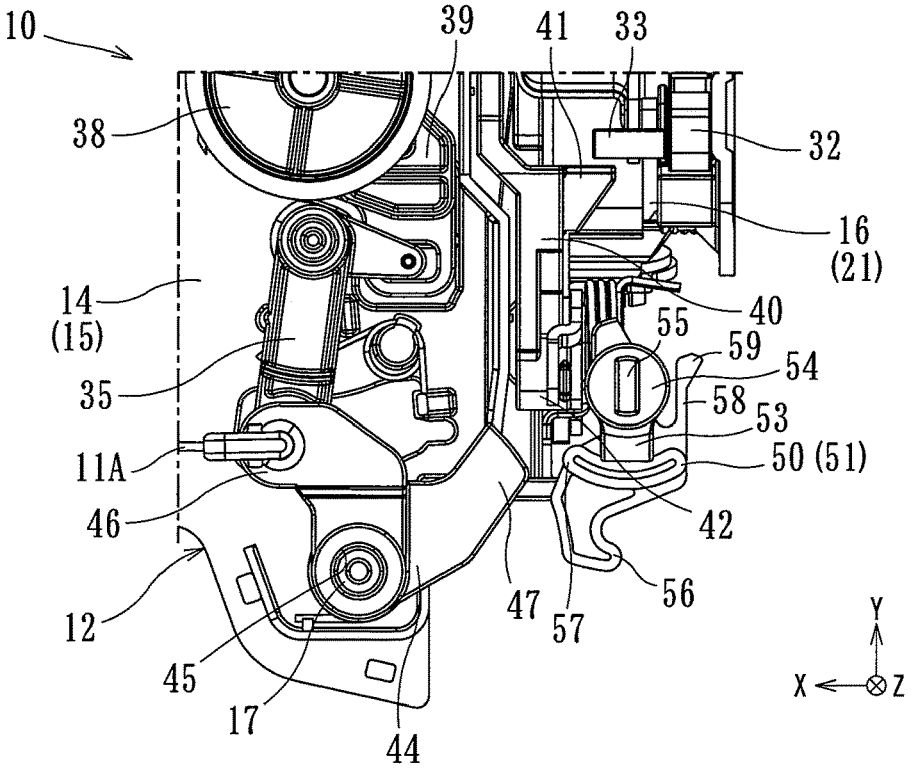
FIG. 4B is a front view showing a state where the inner lever is operated in a locked state.

With respect to the child lever 50 at a child locked position shown in FIG. 3B, as shown in FIG. 4B, even when the inner lever 44 is rotated in an opening operation direction, the pressing portion 47 cannot be brought into contact with the contact portion 56 so that the child lever 50 is maintained at the child locked position. Accordingly, a rotational force of the inner lever 44 cannot be transmitted to the link 40 and hence, power cannot also be transmitted to the claw 32. As a result, even when the link 40 is in a door unlocked state, the door 1 cannot be opened.

In this manner, in the child lever 50 according to this embodiment, switching between a child unlocked state and a child locked state, and transmitting of a rotational force of the inner lever 44 to the claw 32 are performed by the same rotational movement. Accordingly, compared to the conventional slide-operation-type child lever, it is unnecessary to perform designing and manufacture of the levers 44, 50 in shape, arrangement and the like with high accuracy.

The child lever 50 at a child unlocked position is switched to a child locked position by being rotated in the first direction, and transmits power to the claw 32 by being rotated in the second direction by contacting of the child lever 50 with the inner lever 44. Accordingly, switching between a child unlocked state and a child locked state can be unfailingly performed and, at the same time, a rotational force of the inner lever 44 can be transmitted to the claw 32 with certainty.

In addition, in the configuration where switching of a child lock state and transmission of power can be performed by only a rotational operation of the child lever 50, a defective operation minimally occurs even when the child lever 50 is deteriorated over a lapse of time and hence, reliability of the child locking mechanism can be enhanced.

Second Embodiment

Figure 9:
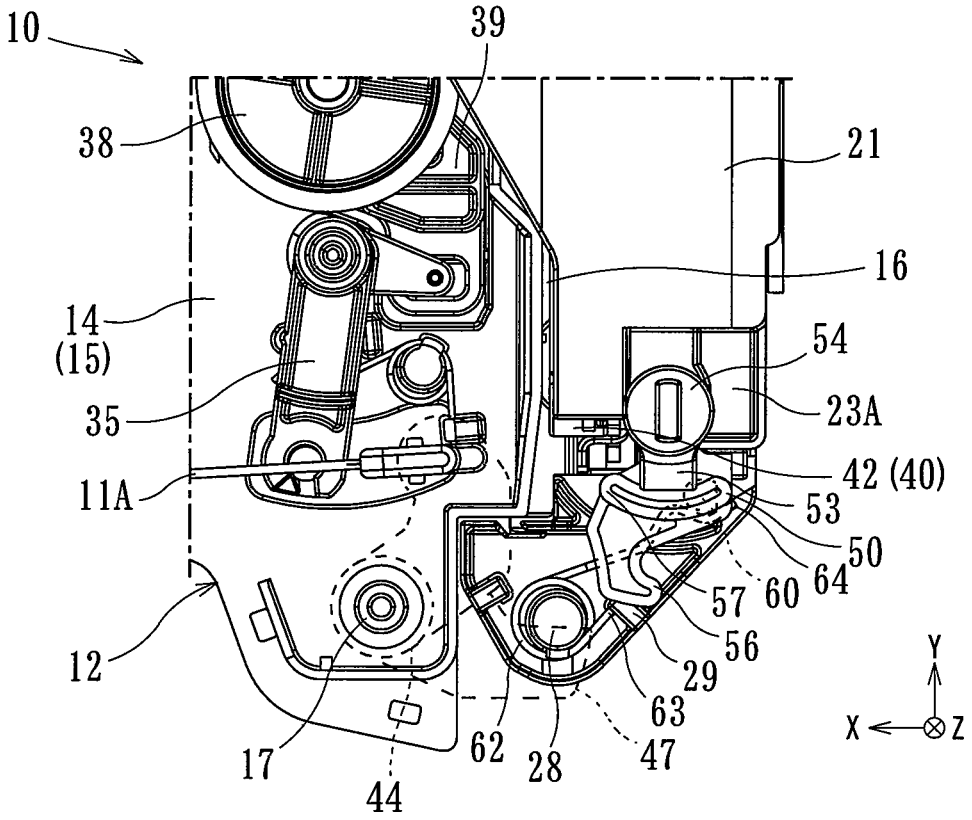
FIG. 9 is a front view showing a portion of a door locking device according to a second embodiment.
Figure 10:
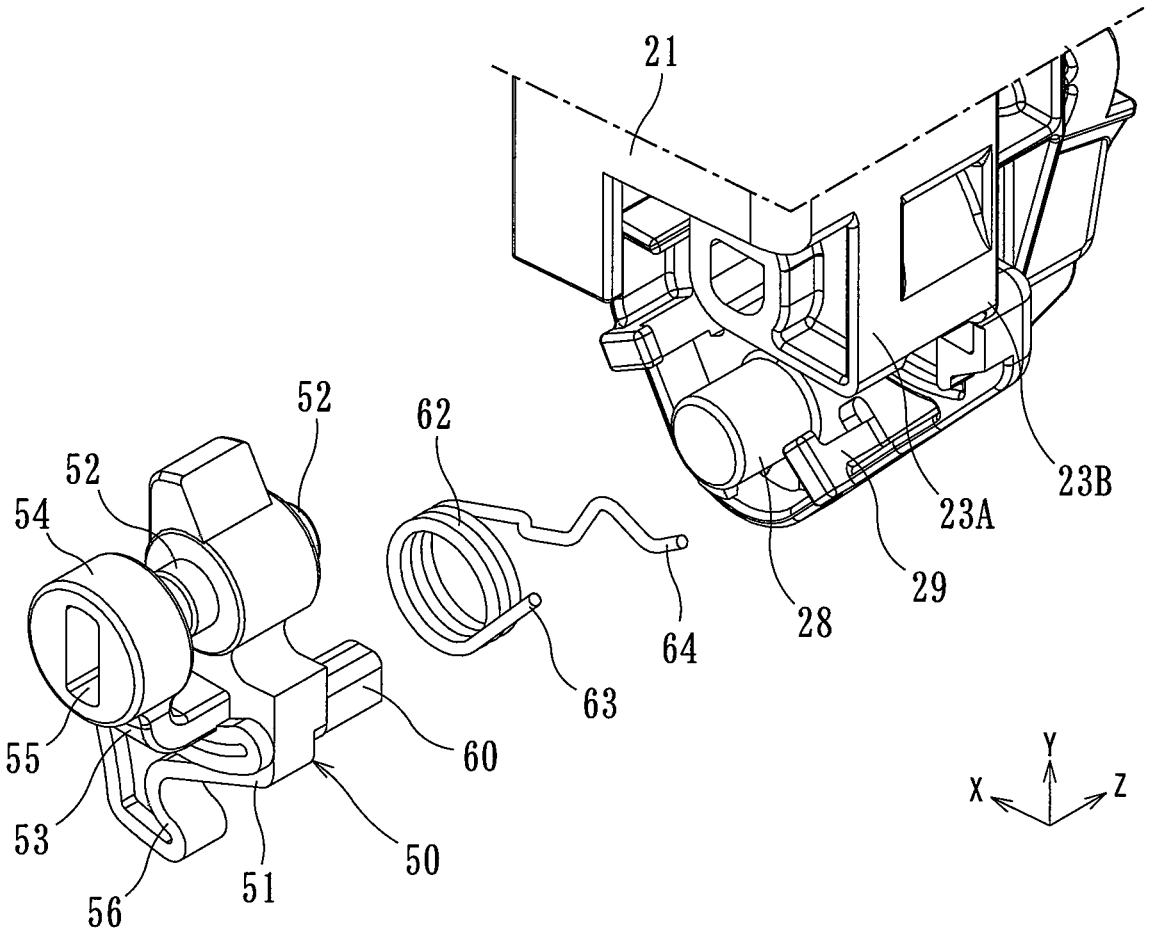
FIG. 10 is an exploded perspective view of a housing, a child lever, and a spring member.

FIGS. 9 and 10 show a door locking device 10 according to a second embodiment. The door locking device 10 of this embodiment differs from the door locking device 10 of the first embodiment with respect to a configuration for preventing the occurrence of rattling of a child lever 50 with respect to a housing 12, while other configurations of the second embodiment are substantially same to the corresponding configurations of the first embodiment. More specifically, in the second embodiment, the child lever 50 is positioned with respect to the housing 12 using a spring member 62 which is wound in a coil shape in place of the biasing portion 58 shown in FIG. 7.

In a sub case 21 of the housing 12, a circular-columnar-shaped spring mounting portion 28 which projects in the Z direction is mounted on the lower part of mounting walls 23A, 23B. A holding portion 29 which holds a first end portion 63 of the spring member 62 is formed on a periphery of the spring mounting portion 28. On the child lever 50, a spring receiving portion 60 which projects from a body portion 51 in the Z direction parallel to a shaft portion 52 is formed in place of the biasing portion 58. A second end portion (one end) 64 of the spring member 62 is locked to the spring receiving portion 60. The second end portion 64 has a crest-shaped bent portion, and resiliently holds the child lever 50 at a child locked position by an inclined portion of the crest-shaped bent portion on one side and at a child unlocked position by an inclined portion on the other side of the crest-shaped bent portion.

The above-mentioned second embodiment can acquire substantially the same manner of operation and advantageous effect as the first embodiment. In the same manner as the first embodiment, the child lever 50 is held at a child unlocked position and a child locked position by the spring member 62 and hence, the generation of noise during traveling of a vehicle can be prevented.

The door locking device 10 of the present invention is not limited to the configurations of the above-mentioned embodiments, and various modifications are conceivable.

For example, the child lever 50 may be positioned with respect to the housing 12 using both the biasing portion 58 of the first embodiment and the spring member 62 of the second embodiment. The child lever 50 and the inner lever 44 may be rotated in the different coordinated planes. With respect to the body portion 51, the shaft portion 52 may be formed on one surface of the body portion 51 in a projecting manner, and the switching operation portion 54 may be formed on the other surface of the body portion 51 in a projecting manner. The rotary axis A2 of the shaft portion 52 and the rotary axis A3 of the switching operation portion 52 may differ from each other. As a matter of course, shapes and arrangement of the child lever 50 and the inner lever 44 can be changed as desired.

What is claimed is:

1. A door locking device comprising:

a latching mechanism configured to detachably lock a striker fixed to a vehicle body;

a link rotating between a door unlocked position where the link is capable of directly acting on the latching mechanism to release the striker by moving linearly, and a door locked position where the link cannot transmit a power for releasing the striker to the latching mechanism;

an inner lever connected to an inner handle by a cable, the inner handle being arranged on a cabin side of a door, the inner lever being capable of rotating around a first axis based on an operation of the inner handle for opening the door; and a child locking mechanism having a child lever capable of rotating around a second axis parallel to the first axis, without linearly moving, the child lever being arranged in a spaced apart manner with respect to the inner lever in a perpendicular direction to the first and second axes, the child lever comprising:

a body portion;

a shaft portion projecting from the body portion and pivotally supported around the second axis;

a switching operation portion for operating the child lever to be selectively positioned at a child unlocked position or a child locked position by rotating the child lever around the second axis; and a contact portion provided in the body portion, wherein when the child lever is operated to be positioned at the child unlocked position, the contact portion is positioned at a rotational angle which allows the contact portion to be in contact with the inner lever and protrudes within a rotational range of the inner lever, and the child lever is configured to be driven to rotate due to contacting of the contact portion with the inner lever as the inner lever is rotated based on the operation of the inner handle, and transmit a rotational force of the inner lever to the link positioned at the door unlocked position so as to cause the link to directly act on the latching mechanism to release the striker, and when the child lever is operated to be positioned at the child locked position, the contact portion is positioned at a rotational angle which does not allow the contact portion to be in contact with the inner lever, and is separated from the rotational range of the inner lever.

2. The door locking device according to claim 1, wherein the switching operation portion is integrally formed with the body portion.

3. The door locking device according to claim 2, wherein a rotary axis of the shaft portion and a rotary axis of the switching operation portion are positioned on the same axis.

4. The door locking device according to claim 3, wherein the shaft portion and the switching operation portion are positioned in a spaced-apart manner from each other along the rotary axis.

5. The door locking device according to claim 4, wherein the switching operation portion is formed on the body portion including the shaft portion by way of an arm.

6. The door locking device according to claim 1, wherein a rotary axis of the inner lever and a rotary axis of the child lever are parallel to each other, and the child lever positioned at the child unlocked position is configured such that the child lever is switched to the child locked position by being rotated in a first direction, and is configured to transmit the rotational force to the latching mechanism by being rotated in a direction opposite to the first direction by receiving the rotational force.

7. The door locking device according to claim 1, wherein a biasing portion for positioning the child lever in a housing is formed on the child lever.

8. The door locking device according to claim 1, further comprising a spring member for positioning the child lever in a housing, and wherein a spring receiving portion to which one end of the spring member is locked is formed on the child lever.

9. The door locking device according to claim 1, wherein a rotary axis of the shaft portion and a rotary axis of the switching operation portion are positioned on the same axis.

10. The door locking device according to claim 9, further comprising a housing where the latching mechanism, the inner lever and the child lever are arranged, wherein the rotary axis of the shaft portion and the rotary axis of the switching operation portion are positioned on the same axis and are pivotally supported on the housing.

* * * * *